US009771215B2

(12) United States Patent
Rogers

(10) Patent No.: US 9,771,215 B2
(45) Date of Patent: Sep. 26, 2017

(54) TRASH CAN WITH BAG DISPENSER

(71) Applicant: Michael G. Rogers, Hobbs, NM (US)

(72) Inventor: Michael G. Rogers, Hobbs, NM (US)

( * ) Notice: Subject to any disclaimer, the term of this patent is extended or adjusted under 35 U.S.C. 154(b) by 0 days.

(21) Appl. No.: 14/942,763

(22) Filed: Nov. 16, 2015

(65) Prior Publication Data

US 2016/0137411 A1 May 19, 2016

Related U.S. Application Data

(60) Provisional application No. 62/079,607, filed on Nov. 14, 2014.

(51) Int. Cl.
*B65D 25/14* (2006.01)
*B65F 1/06* (2006.01)
*B65F 1/16* (2006.01)

(52) U.S. Cl.
CPC ..... *B65F 1/062* (2013.01); *B65F 1/16* (2013.01)

(58) Field of Classification Search
CPC ..... B65F 1/00; B65F 1/02; B65F 1/04; B65F 1/06; B65F 1/062; B65F 1/08; B65F 1/1421
USPC .... 220/495.06, 495.07, 495.05, 495.01, 737; 206/390, 554, 555
See application file for complete search history.

(56) References Cited

U.S. PATENT DOCUMENTS 5,551,569 A * 9/1996 Garvin-Mazzarisi ..... B65F 1/14 206/457
5,628,424 A * 5/1997 Gola ..... B65F 1/062 220/495.07
6,126,031 A * 10/2000 Reason ..... B65F 1/062 220/495.04
D493,267 S * 7/2004 Strobel ..... D34/7
D761,514 S * 7/2016 Harbhajan ..... D34/1
2005/0258177 A1* 11/2005 Woodson ..... B65F 1/062 220/495.07

* cited by examiner

*Primary Examiner* — Steven A. Reynolds
*Assistant Examiner* — Javier A Pagan
(74) *Attorney, Agent, or Firm* — Law Office of Jeff Williams; J. Oliver Williams

(57) ABSTRACT

The present application includes a trash can assembly having a container configured to hold a trash bag. The container includes a door assembly in communication with one or more walls of a container. The door assembly includes an opening to permit the passage of a collection of trash bags. The assembly also includes a defined internal compartment to house and protect the trash bags within the container. The compartment may include a slot for withdrawal of a trash bag internally or may be sealed with a slot in the door for external withdrawal.

12 Claims, 4 Drawing Sheets

TRASH CAN WITH BAG DISPENSER

BACKGROUND

1. Field of the Invention

The present application relates generally to trash cans and, more particularly, to a trash can assembly with an internal bag dispenser.

2. Description of Related Art

Trash cans are used to store trash prior to disposal. Bags are inserted into a container and then filled with the trash. Trash cans can come with various different types of lids or covers to permit the selective sealing of the lid to contain smell. Also trash cans may include contraptions to permit the opening of the lid with our feet by pushing a pedal. These advancements have made some improvements for society.

However, a disadvantage of typical trash cans is their inability to typically store trash bags. Trash bags are purchased within boxes of different sizes. Normally, these boxes are stored separately from the trash can. Replacing a bag requires extra time and effort to find the box of bags at a different location from the trash can. Each box adds to the already present clutter in a kitchen.

Furthermore, it is common in commercial settings to store one or two extra bags at the bottom of the trash can for use when the current bag is full and removed. This is done to save the time and effort required to obtain a trash bag elsewhere. However, this too has some disadvantages. These bags have to be placed prior to attaching the "in-use" bag or at the time of disposing of the trash. Additionally, these bags rest at the bottom where spills or garbage can collect, making handling them repulsive and unsanitary.

It is understood that some steps have been taken in trash cans to incorporate bags. Typically a lower portion of the can is consumed by a compartment which results in the overall internal height of the trash can being decreased or wherein the overall external height of the trashcan is increased to accommodate the fully encompassing bottom compartment. The changes in external heights result in restricted ability to incorporate and store the trash can in conventional locations, namely, under the sink or in a drawer. Additionally, the internal height change results in an inability to fill the trash bag as full prior to disposing, therefore increasing the amount of trash bags used.

It is desirable to provide a trash can assembly to permit the regular internal and external heights to be maintained while incorporating a storage compartment for trash bags. Although great strides have been made, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
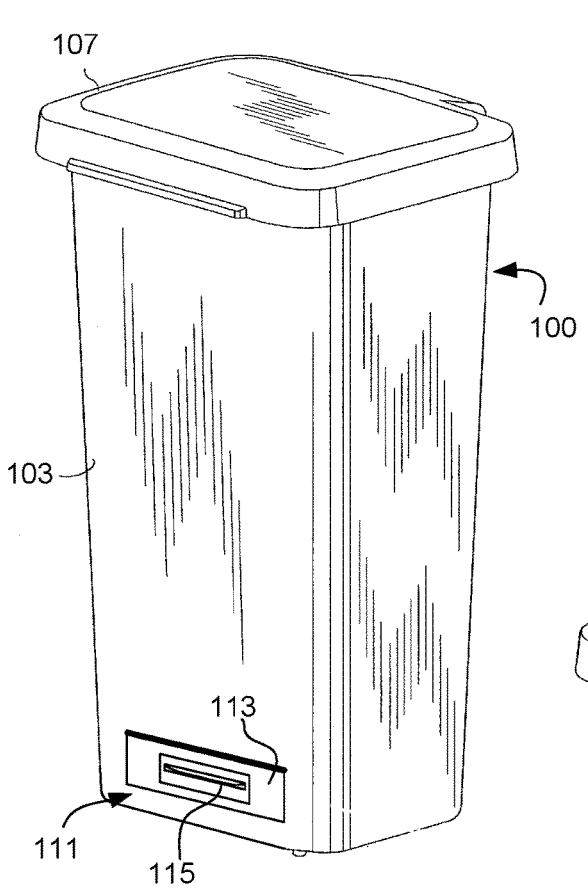
FIG. 1 is a perspective view of a trash can assembly according to the preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The assembly and method in accordance with the present application overcomes one or more of the above-discussed problems commonly associated with conventional trash cans. Specifically, the assembly of the present application is configured to include an internal compartment for the storage of a roll of trash bags. The bags are accessible for dispensing from either one of the interior of the trash can or the exterior of the trash can. An external door is used to locate the trash bags within the compartment. The compartment is configured to remain compact and not extend out into the floor of the trash can any more than necessary in order to allow for the trash bags to extend the full length of the trash can without modifying the external height of the trash can. These and other unique features of the assembly are discussed below and illustrated in the accompanying drawings.

The assembly will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The trash can assembly of the present application is illustrated in the associated drawings. The assembly includes a trash container having an internal defined compartment, and a door. Referring now to the drawings wherein like reference characters identify corresponding or similar elements in form and function throughout the several views.

FIGS. 1-5 illustrate a trash can assembly 101. Assembly 101 includes a container 100 having one or more side walls 103 and a base portion 105. Walls 103 are integrally coupled to base portion 105 so as to form a central volume. The central volume is bounded by walls 103 on the sides and base portion 105 on the bottom. The upper area of the central volume is optionally bounded by a lid 107. Assembly 101 includes an internal compartment 109 and a door assembly 111 having a door 113.

Figure 2:
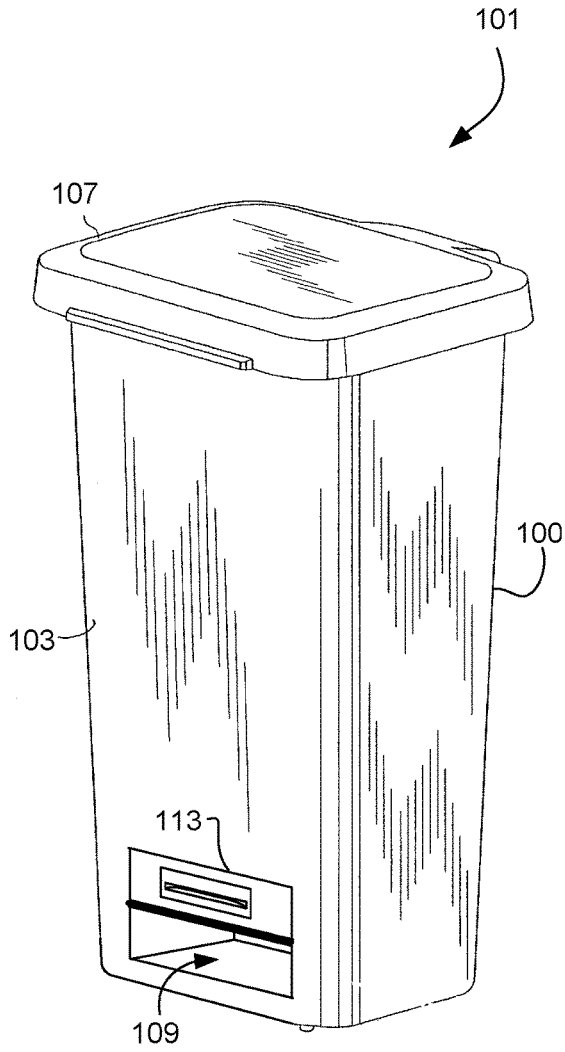
FIG. 2 is a perspective view of the trash can assembly of FIG. 1 with a door opened.

Door assembly 111 is in communication with one or more walls 103. Door assembly 111 is configured to provide an entry point (i.e. opening) for the insertion of one or more replacement trash bags into internal compartment 109. The replacement trash bags may be in a roll or loosely stacked. Door assembly 111 includes door 113. Door 113 is configured to operate between an open and closed position. When closed, door 113 covers an opening in the wall 103 that serves as the entry point for internal compartment 109. FIG. 1 shows door 13 in the closed position while FIG. 2 shows door 113 in the open position. Door 113 is hinged relative to wall 103, but it is understood that other types of connections may be realized. Door 113 may include a latching mechanism to keep door 113 in the closed position and/or in the open position. Some examples of ways are: interference fit, magnets, buttons, latches, and so forth. In some embodiments it is understood that no latching mechanism may be used and reliance upon gravity is used. Door 113 optionally includes a handle 115 to operate door 113.

Figure 3:
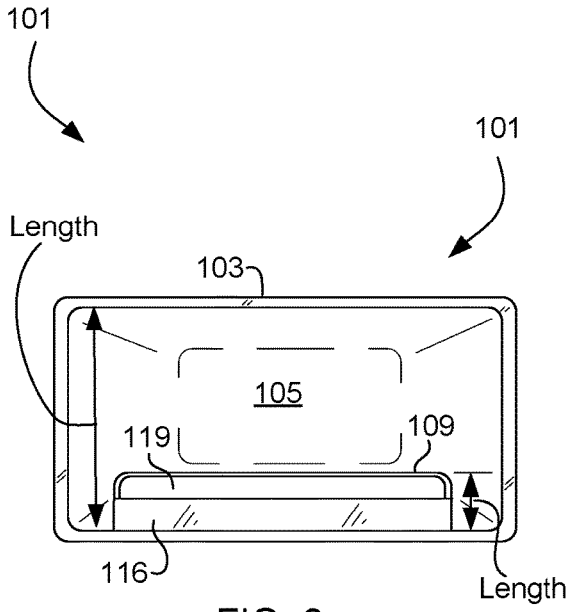
FIG. 3 is a top view of the trash can assembly of FIG. 2 without a lid.

As seen clearly in FIG. 3, container 100 includes an internal compartment 109. Compartment 109 defines an interior volume within the central volume of container 100. Compartment 109 extends along base 105 a portion and is configured to allow an in-use trash bag to extend the full interior length of walls 103 without the need to increase the external height of container 100. In other words, compartment 109 covers only a small portion of base 105 to allow the in-use trash bag to pass beyond a top 116 surface of compartment 109 and reach base 105. This provides the benefit of allowing the overall external height of container 100 to remain unchanged from conventional sized containers. Additionally, it allows for the in-use trash bag to fill to its designed full capacity without sacrificing room due to a decreased internal height of walls 103. As seen in FIG. 3, one example of the sizing of compartment 109 relative to base 105 is wherein the length of compartment 109 is less than $\frac{1}{3}^{rd}$ the length of base 105. It is understood that this example is to permit a majority of the space around base 105 to be made available to the in-use trash bag. More or less space may be used.

Figure 5:
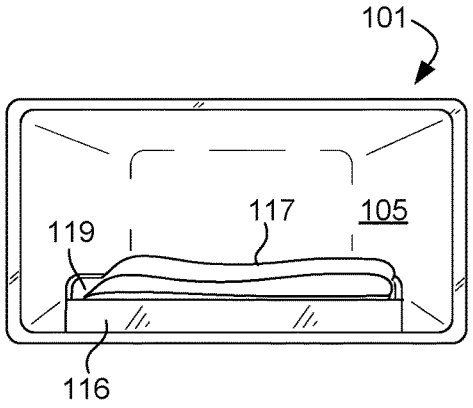
FIG. 5 is a top view of the trash can assembly of FIG. 4 without a lid.
Figure 4:
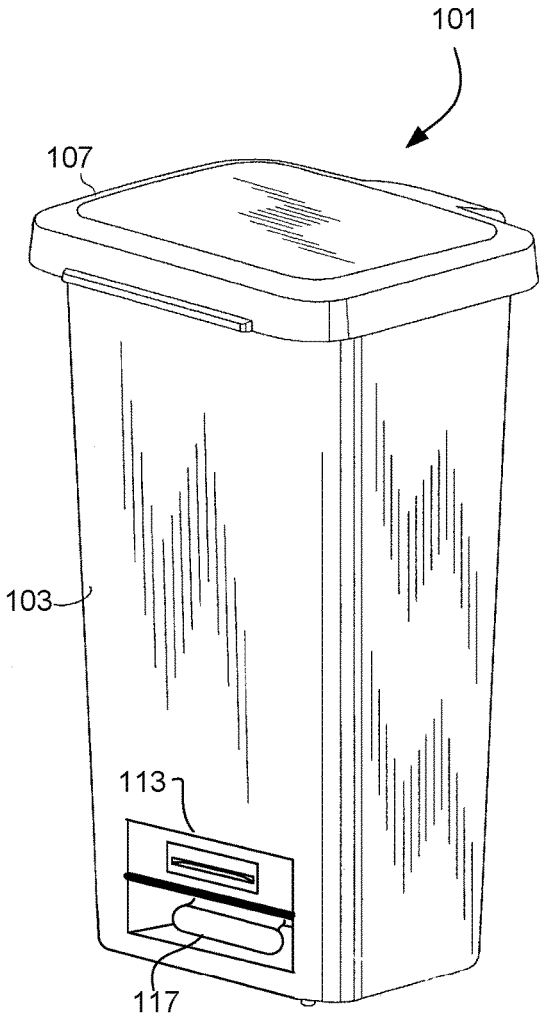
FIG. 4 is a perspective view of the trash can assembly of FIG. 2 holding a roll of trash bags.

Referring now to FIGS. 4 and 5, replaceable trash bags 117 are depicted within internal compartment 109. In this embodiment, bags 117 are pulled through a slot 119 in compartment 109 that is located internally to the central volume. Therefore once the in-use trash bag is removed, a user merely has to reach inside container 100 to withdraw bag 117 through slot 119. The walls that define compartment 109 are useful for preventing trash, liquids, and debris that spills around the in-use trash bag within the central volume to contaminate bags 117. Door assembly 111 provides the exterior access to compartment 109 and slot 119 provides an interior withdrawal point for each bag 117.

Referring now to FIGS. 6-10 in the drawings, an alternative embodiment of trash can assembly 101 is illustrated. Like elements between the two embodiments will be assigned like numerical identifiers. Trash can assembly 201 is similar in form and function to that of assembly 101 except as herein described. Assembly 201 includes door assembly 211 and internal compartment 209.

Figure 6:
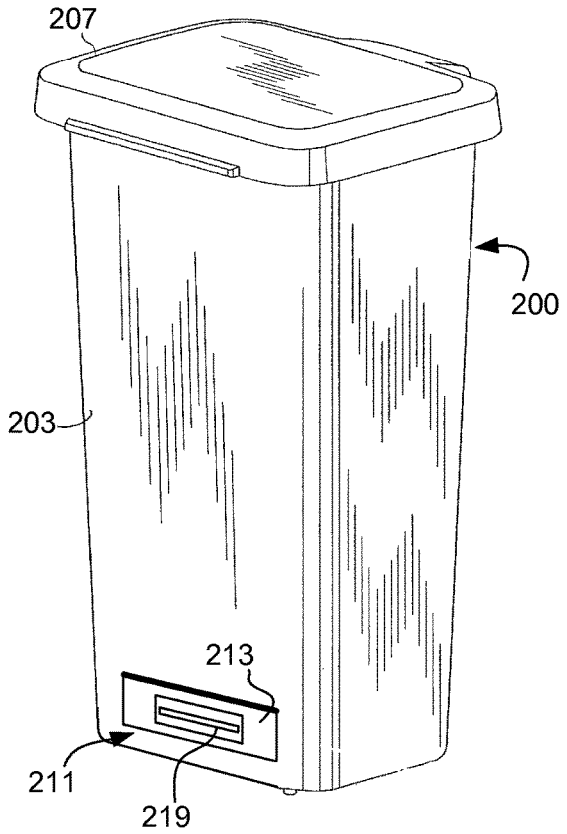
FIG. 6 is a perspective view of an alternative embodiment of the trash can assembly of FIG. 1.
Figure 7:
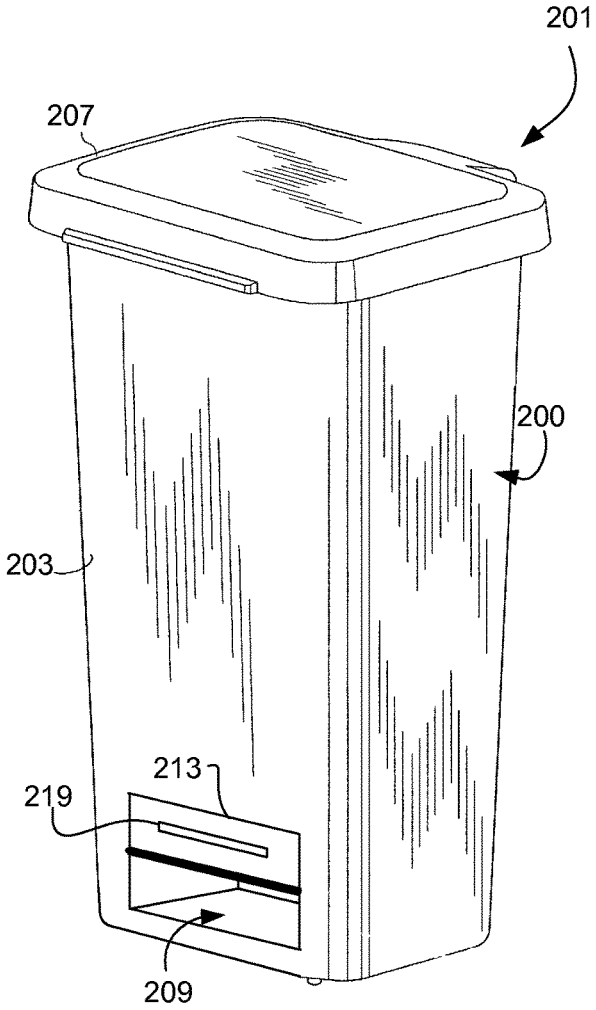
FIG. 7 is a perspective view of the trash can assembly of FIG. 6 with a door opened.
Figure 8:
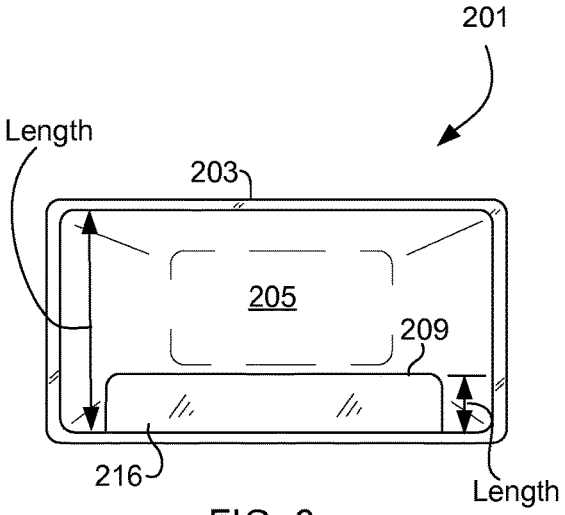
FIG. 8 is a top view of the trash can assembly of FIG. 7 without a lid.

Door assembly 211 operates in similar form and function to that of door assembly 111. A door 213 operates between two positions, open and closed as seen in FIGS. 6 and 7 particularly. However in this embodiment, door assembly 211 includes a slot 219 for the passage of replacement trash bags 117.

Figure 9:
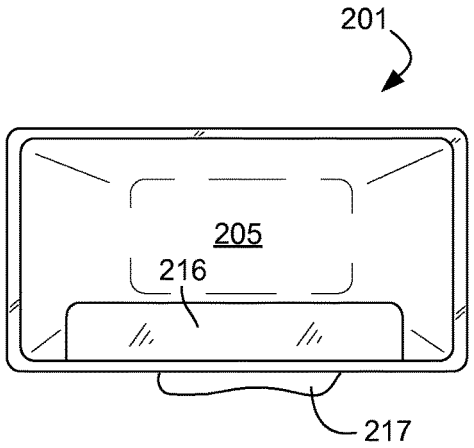
FIG. 9 is a perspective view of the trash can assembly of FIG. 7 holding a roll of trash bags.
Figure 10:
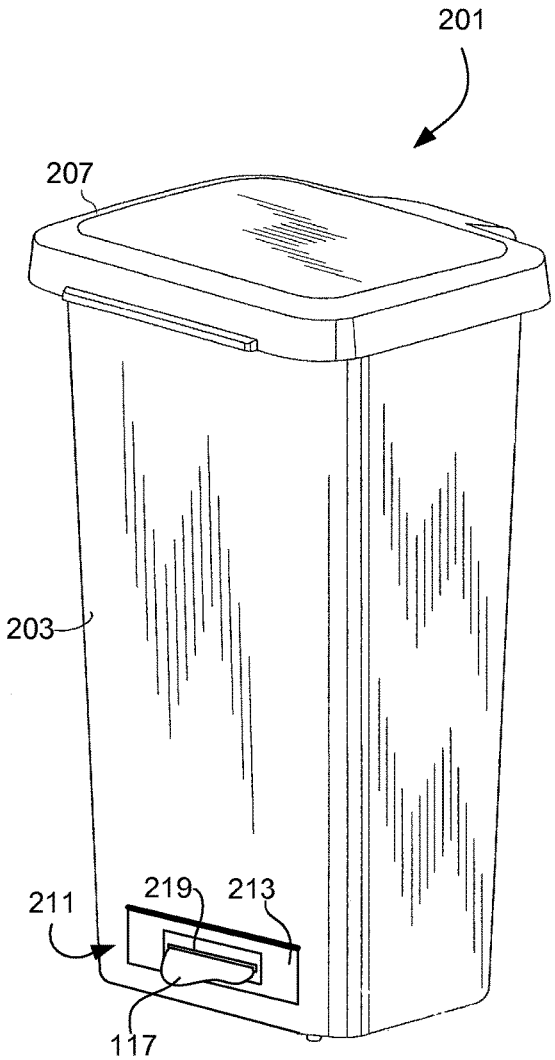
FIG. 10 is a top view of the trash can assembly of FIG. 9 without a lid.

Assembly 201 is configured to seal off compartment 209 from the central volume of container 100. Trash bags 117 are withdrawn through door 213 as opposed to the interior of container 200. This allows a user the ability to withdraw any number of bags 117 without the need to remove the in-use trash bag within the central volume. FIGS. 9-10 illustrate bags 117 within compartment 209. Compartment 209 is sealed from the central volume of container 200.

It is understood that lid 107/207 may be operational to open and close with the use of hands or via handless methods such as a foot pedal.

In use, assembly 101 and 201 include obtaining a container that is bound by a number of walls and a base. Inserting a roll of replacement trash bags into an internal compartment within a central volume of the container. The in-use trash bag is inserted into the central volume and filled over a period of time. During this time, access to the replacement trash bags may be limited depending on the configuration of the compartment and the door assembly. Embodiments may allow for the withdrawal of replacement bags either internally via the compartment, externally through a slot in the door, or via both internal and external means.

Prior to storage in the internal compartment, replacement trash bags may be removed from their shipping and storing box. The box is not necessary for use in the present applications. It is important to note that the door assembly is useful to allow the restocking or access to the collection of replacement bags as a whole whereas the slots, whether internally or external on the door, are for access to and withdrawal of individual bags out of the entire collection.

The current application has many advantages over the prior art including at least the following: (1) ability to maintain conventional height of trash cans and allow the full interior height of the walls; (2) optional sealed internal compartment; (3) either external or internal access to replacement trash bags; (4) storage of trash bags within the container; and (5) increased convenience and decreased clutter.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A trash can assembly, comprising:

a container configured to hold a trash bag, the container includes one or more side walls and a base, the side walls extend around the base to define a central volume;

a door assembly included within the one or more side walls, the door assembly configured to selectively operate between an open position and a closed position, the door assembly including a door having a slot there through; and an internal compartment defined within the central volume and coupled to the one or more side walls, the internal compartment configured to support a roll of trash bags within the container, the internal compartment including a slot to provide an interior withdrawal location within the central volume while the door assembly provides exterior access into the internal compartment;

wherein the roll of trash bags are configured to enter and leave the base portion through the door assembly while the trash bag is within the container; and wherein the roll of trash bags are dispensed through at least one of the slot of the door and the slot of the internal compartment when the door is in a closed position.

2. The trash can assembly of claim 1, wherein the door assembly is hinged along the one or more side walls.

3. The trash can assembly of claim 1, further comprising:

a lid configured to selectively rest on the one or more walls of the container.

4. The trash can assembly of claim 3, wherein a portion of the lid selectively opens prior to trash being placed in the trash bag.

5. The trash can assembly of claim 1, wherein the internal compartment is configured to extend out along the base of the container less than $\frac{1}{3}^{rd}$ the length of the base.

6. The trash can assembly of claim 1, wherein the internal compartment is configured to allow an in-use trash bag around the one or more side walls to extend past the top of the internal compartment.

7. The trash can assembly of claim 1, wherein the internal compartment and the door permit for the withdrawal of the replacement trash bags.

8. A method of operating a trash can, comprising:

obtaining a container, the container including one or more walls being supported by a base portion so as to define an internal volume;

inserting a roll of replacement trash bags into an internal compartment within the container, the roll of replacement trash bags passing through a door within the one or more walls of the container, the door operating between an open position and a closed position, the door including a slot there through;

filling an in-use trash bag;

removing the in-use trash bag; and obtaining a replacement trash bag from the roll of replacement trash bags in the internal compartment for use, the internal compartment communicating with the internal volume through a slot, the roll of replacement trash bags being dispensable both externally through the slot in the door and internally within the internal volume through the slot in the internal compartment;

wherein dispensing of the replacement trash bags through the slot in the door is performed when the door is in the closed position.

9. The method of claim 8, further comprising:

inserting the roll of replacement trash bags into the internal compartment while the in-use trash bag is present within the walls.

10. The method of claim 9, wherein the roll of replacement trash bags are removed from their box prior to insertion into the internal compartment.

11. The method of claim 8, wherein the internal compartment is configured to extend out along the base of the container less than $\frac{1}{3}^{rd}$ the length of the base.

12. The method of claim 8, wherein the internal compartment is configured to allow an in-use trash bag around the one or more side walls to extend past the top of the internal compartment.

* * * * *